US006049032A

United States Patent [19]

Liao

[11] Patent Number: 6,049,032

[45] Date of Patent: Apr. 11, 2000

[54] SWINGING STAND TRANSMISSION DEVICE FOR PEDAL OPERATED CYMBALS

[75] Inventor: Tsun-Chi Liao, Taichung, Taiwan

[73] Assignee: Hwa Shin Musical Instrument Co., Ltd., Taichung, Taiwan

[21] Appl. No.: 09/318,800

[22] Filed: May 26, 1999

[51] Int. Cl.[7] ..... G10D 13/02

[52] U.S. Cl. ..... 84/422.3; 84/422.1; 84/422.2

[58] Field of Search ..... 84/422.1, 422.2, 84/422.3, 411 R, DIG. 25, 453

[56] References Cited

U.S. PATENT DOCUMENTS

| | | | |
|---|---|---|---|
| 1,508,390 | 9/1924 | Gladstone et al. | 84/411 R |
| 1,613,978 | 1/1927 | Berton | 84/422.3 |
| 4,488,471 | 12/1984 | Youakim | 84/422.3 |
| 5,192,822 | 3/1993 | Hoshino | 84/422.3 |
| 5,251,528 | 10/1993 | Kurosaki | 84/422.3 |
| 5,438,903 | 8/1995 | Cropek | 84/422.3 |
| 5,717,152 | 2/1998 | Liao | 84/422.3 |

FOREIGN PATENT DOCUMENTS 3937597 5/1991 Germany .

10-232670 2/1998 Japan .

*Primary Examiner*—David Martin
*Assistant Examiner*—Kim Lockett
*Attorney, Agent, or Firm*—Bacon & Thomas, PLLC

[57] ABSTRACT

An swinging stand structure for pedal operated cymbals with a swinging stand unit which includes a universal joint connected to a central draw bar, a reversed L-shape swing stand having its top end connected to the universal joint and its bottom end set up an opening, a rod stand having a set-up of an opening at its center portion, set up at the bottom of the base stand of the pedal cymbals, a connecting bar with an upper connecting block contained in the opening of the swinging stand and a lower connecting block contained in the opening of the rod stand, pivoted with respect to pivoting rods respectively, and a chain link having its top end connected to a horizontal block of the swinging stand and its bottom end connected to an end of the pedal. The foregoing mechanism with the central draw bar penetrating through the base stand, and connecting the swinging stand unit as well as the pedal, the user can push down the pedal with ease and with economy of motion while the swinging stand unit maintains a high level of stability, without generating excessive rattles or frictional noises, to improve the quality of the response of the cymbals.

3 Claims, 6 Drawing Sheets

SWINGING STAND TRANSMISSION DEVICE FOR PEDAL OPERATED CYMBALS

BACKGROUND OF THE INVENTION

1. Field of the Invention

The present invention relates to an improved music instrument. and more particularly to an improved swinging stand structure of pedal cymbals.

2. Description of the Related Art

With reference to FIG. 1, the overall framework of a pedal operated cymbals of the prior art includes a central hollow tube fastening at a tripod wherein a stationary lower cymbal is set up at the top portion of the central hollow tube. A central draw bar, having a movable upper cymbal set up at the top end thereon and being inserted through the central hollow tube, has its bottom end penetrating through the center of a base stand and is connected to the front end of a pedal through a chain unit. As the pedal is pedaled down, the central draw bar will be pulled down to make the movable upper cymbal hit the lower stationary cymbal so as to emit a cymbal sound, afterward, the central draw bar needs to be raised up to restore back to its original position in order to separate the upper and lower cymbals, therefore, a restoring spring unit is set up in the central hollow tube to prop up the central draw bar so as to make the cymbals separated.

However, although the pedal is in association with the restoring spring unit to control the hitting and separation of the upper and lower cymbals, there is a problem that exists. For instance, in order to make the central draw bar raise up quickly and restore back to the original position, the spring constant of the restoring spring unit needs to be relatively large, but this will result in the fact that the users need to apply a relatively large force down onto the pedal, causing user fatigue. On the contrary, if the spring constant is adjusted to be relatively small to facilitate the users to apply a lower force down onto the pedal, this will then cause the lowering of the restoring speed, consequently, affecting the quality of cymbal response.

SUMMARY OF THE INVENTION

The primary objective of the present invention is to provide an improved swinging stand structure for pedal operated cymbals that allows the user push down the pedal with ease and with economy of motion. The swinging stand unit possesses a high of stability without generating rattling or frictional noise, thereby, elevating the quality of response of the cymbals.

The embodiment of the present invention in order to achieve the foregoing objective is described as follows:

A swinging stand having its top end connected to a universal joint has an opening set up at its bottom end while a rod stand setting at the bottom of a base stand has also an opening set up at its center, and a connecting bar having connecting block at each end contained respectively in the openings of the swinging stand and that of the rod stand is pivoting at their both ends through a pivoting rod set up respectively 7 thereof, besides, a chain link has its one end connected to the horizontal block of the swinging stand and another end connected to a pedal. By the foregoing mechanism, the user can push down the pedal with ease and with economy of motion while the swinging stand unit possesses high level of stability without generating rattling or frictional noise, thereby, elevating the quality of response of the cymbals.

BRIEF DESCRIPTION OF THE DRAWINGS

For a better understanding of the present invention, reference will now be made by way of embodiments to the accompanying drawings.

DETAILED DESCRIPTION OF THE PREFERRED EMBODIMENT

Figure 1:
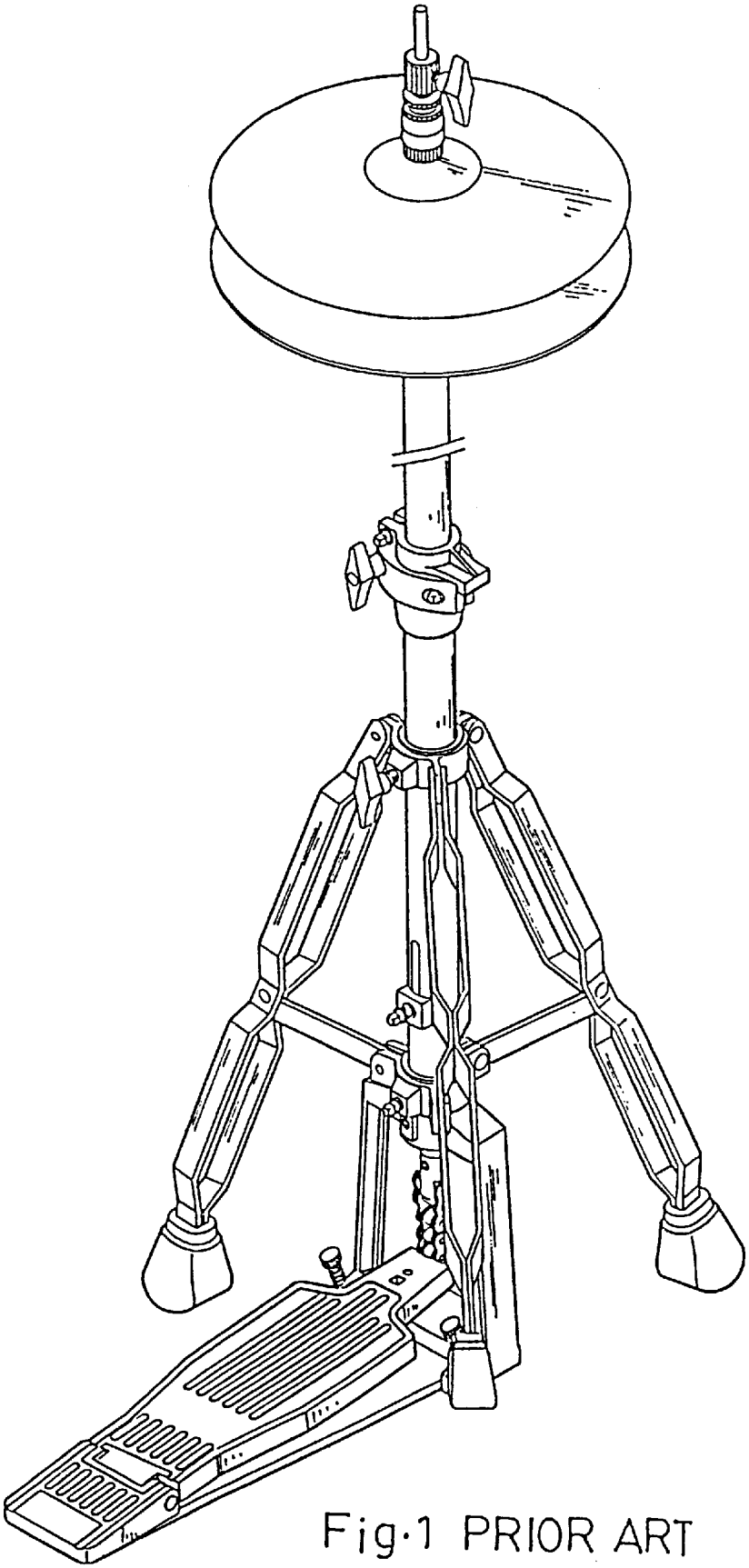
Fig·1 PRIOR ART
FIG. 1 is the overall outward appearance of a pedal cymbals of the prior art.
Figure 2:
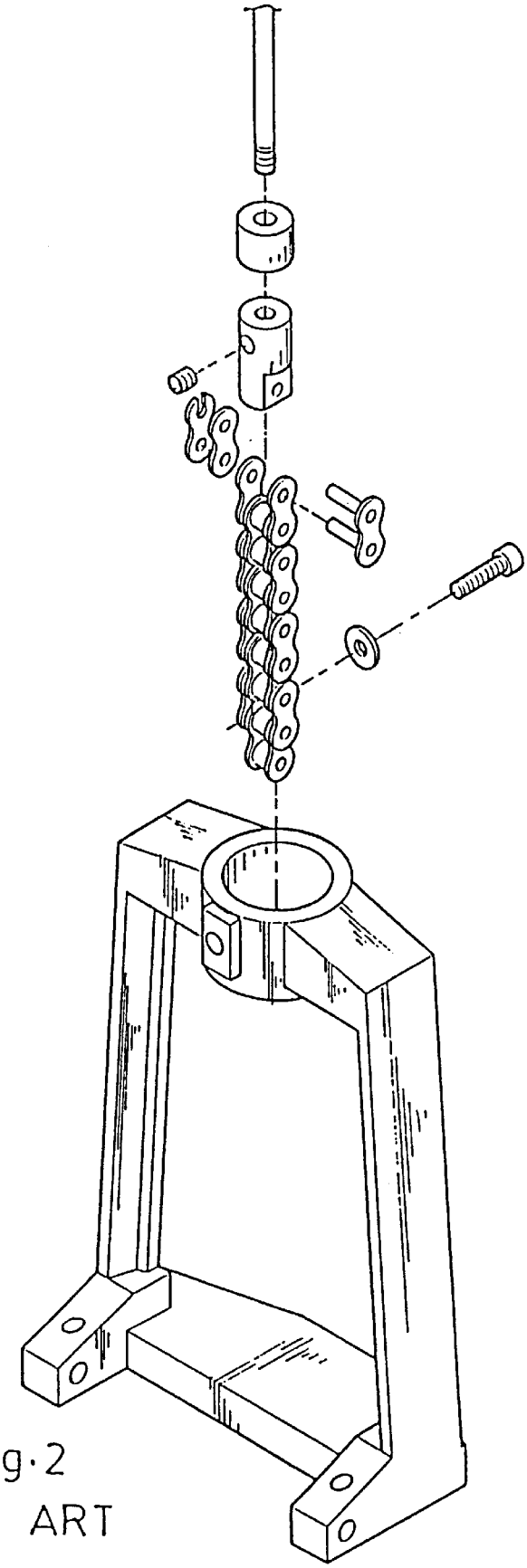
Fig. 2 PRIOR ART
FIG. 2 is the exploded view of the central draw bar and the pedal connecting unit of the prior art.
Figure 3:
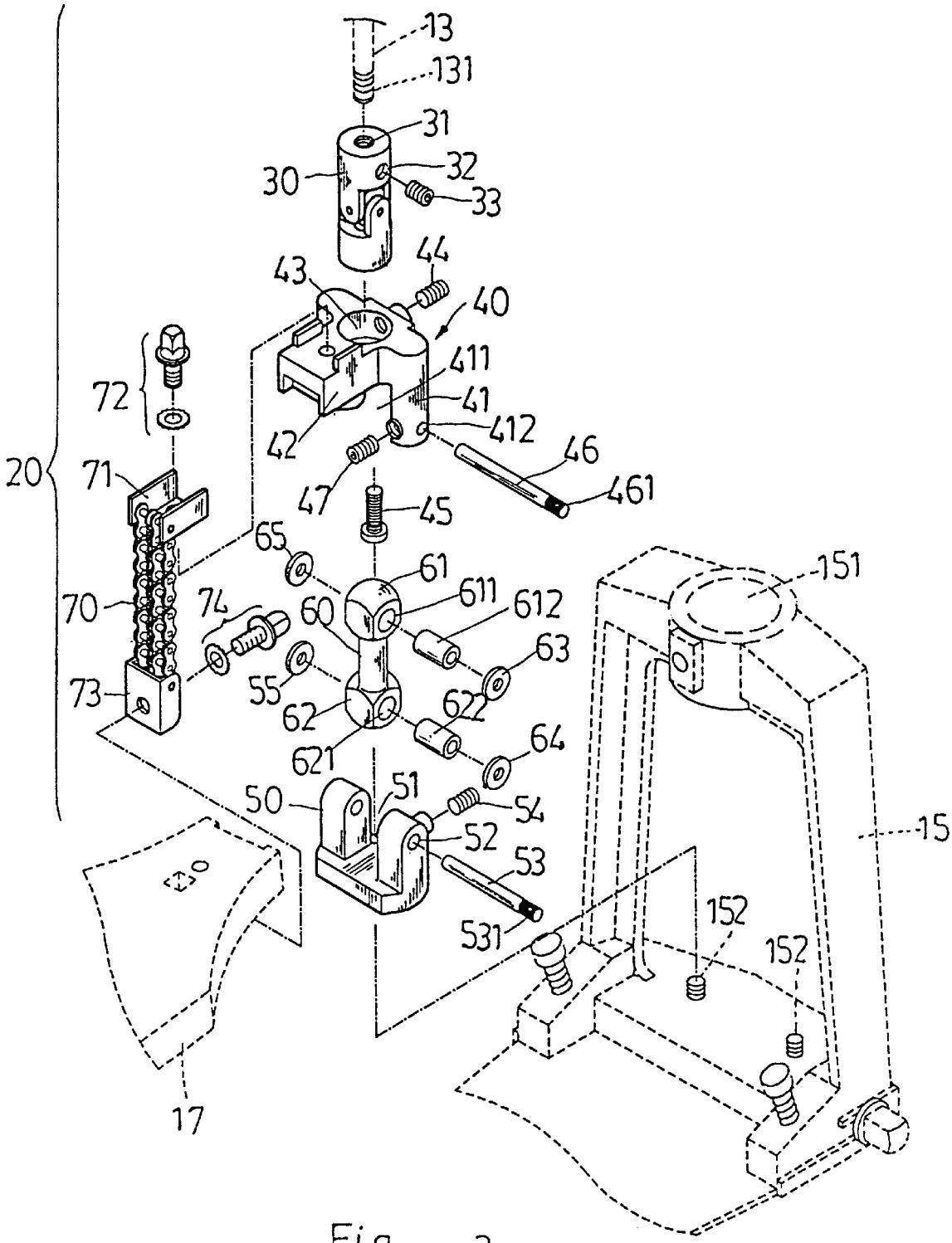
FIG. 3 is the exploded view of the present invention.
Figure 4:
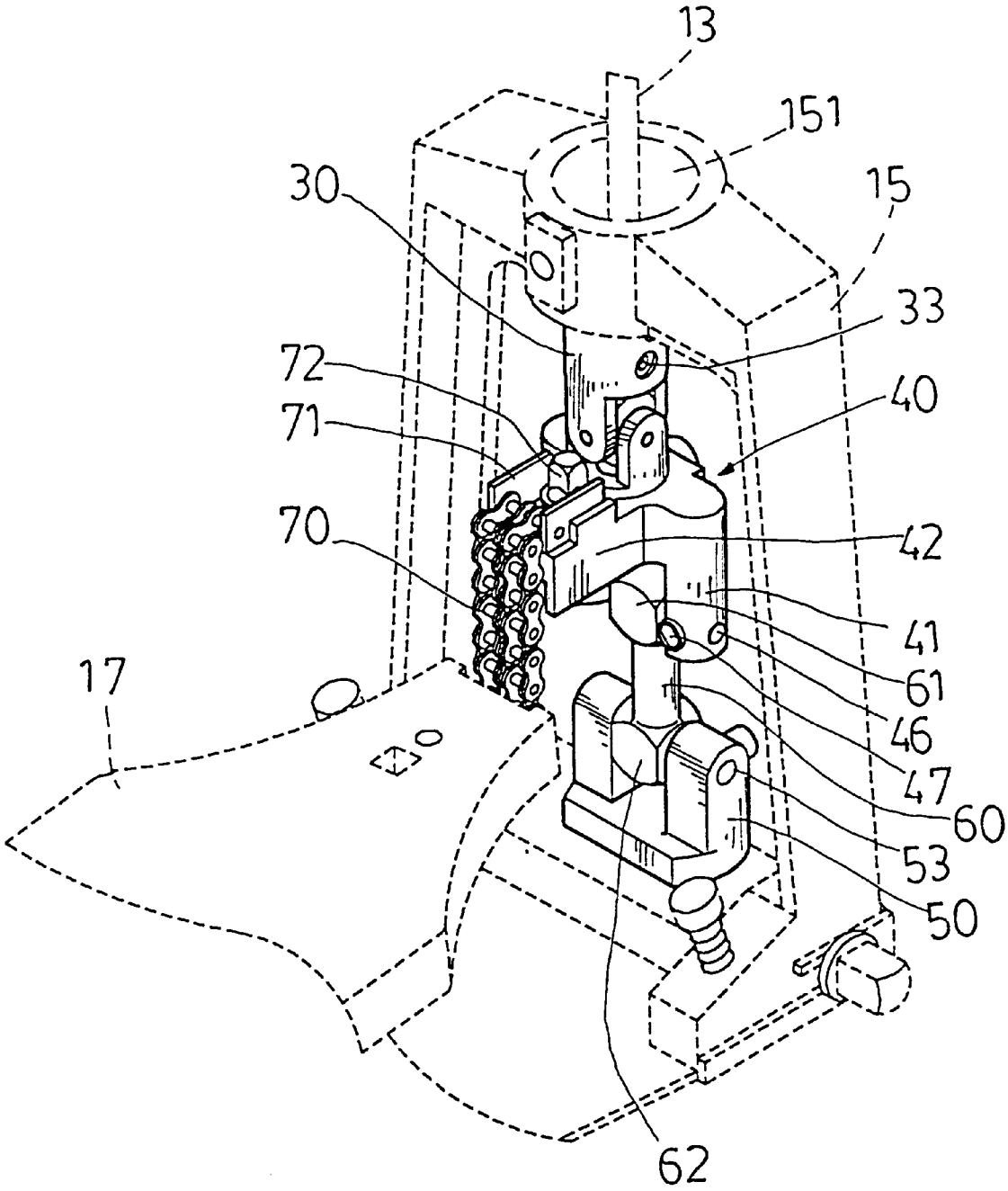
FIG. 4 is the outward appearance of the assembly of the present invention.

With reference to FIG. 3 and FIG. 4, the present invention is an improved swinging stand structure for pedal operated cymbals wherein the mechanism at the bottom end of a central draw bar 13 that is connected to the upper cymbal penetrates through the opening 151 of the base stand 15 and connects to a pedal by a kind of swinging stand unit 20 is similar to the prior art.

The swinging stand unit 20 of the present invention includes the following components:

A universal joint 30 wherein a screw hole 3, 1 is provided at the top end to be matched by the screw segment 131 provided at the bottom end of the central draw bar 13 such that the universal joint 30 is connected to the central draw bar 13 by screw connection, and besides, a small hole 32 is provided on the side of the universal joint 30 for a flat head screw 33 to prop up at one side of the central draw bar 13.

A swinging stand 40 having a reversed L-shape further includes a vertical block 41 and a horizontal block 42, and a recess 43 which is provided at the top surface of the swinging stand 40 to contain the bottom end of the universal joint 30, and a flat head screw 44 is used to prop up the universal joint 30 in order to fix the universal joint 30 to the swinging stand 40, and also an opening 411 is provided at the bottom of the vertical block 41 and a penetrating hole 412 is set up on each of the bottom ends of the vertical block 41 on both sides of the opening 411, and a screw 45 is connected to the universal joint 30 to secure the stand 40 to the bottom of the universal joint 30.

A U-shaped rod stand 50 having a central opening 51 and a penetrating hole 52 is provided on each of the side wall, and the rod stand 50 is tightened up at the bottom of the base stand 15 by two screws 152.

A connecting bar 60 wherein an upper connecting block 61 is provided at its upper end, is contained in the opening 411 of the swinging stand 40 and a lower connecting block 62 provided at the lower end is contained in the opening 51 of the rod stand 50. The connecting bar 60 is pivoted at both ends with pivoting rods 46 and 53 penetrating through each of the penetrating holes 412, 52, block holes 611, 621 and lining tubes 612, 622 respectively, and pinking segments 461, 531 at the end of respective pivoting rods 46, 53 are used to enhance frictional effect in order to position the pivoting rods 46 and 53 at the holes 412 and 52. Moreover, prop-up screws 47, 54 are used to tighten up the pivoting rods 46 and 53. and the lining tubes 612, 622 act as buffer to reduce friction while the connecting bar 60 is pivoting at the pivoting rods 46 and 53, and washers 63, 64 are used to reduce friction as well.

A chain link 70 with a platform 71 at one end connected to the top surface of the horizontal block 42 of the swinging stand 40 is tightened up by a screw 72 while the other end having a fixing piece 73 is connected to an end of the pedal 17.

Figure 5A:
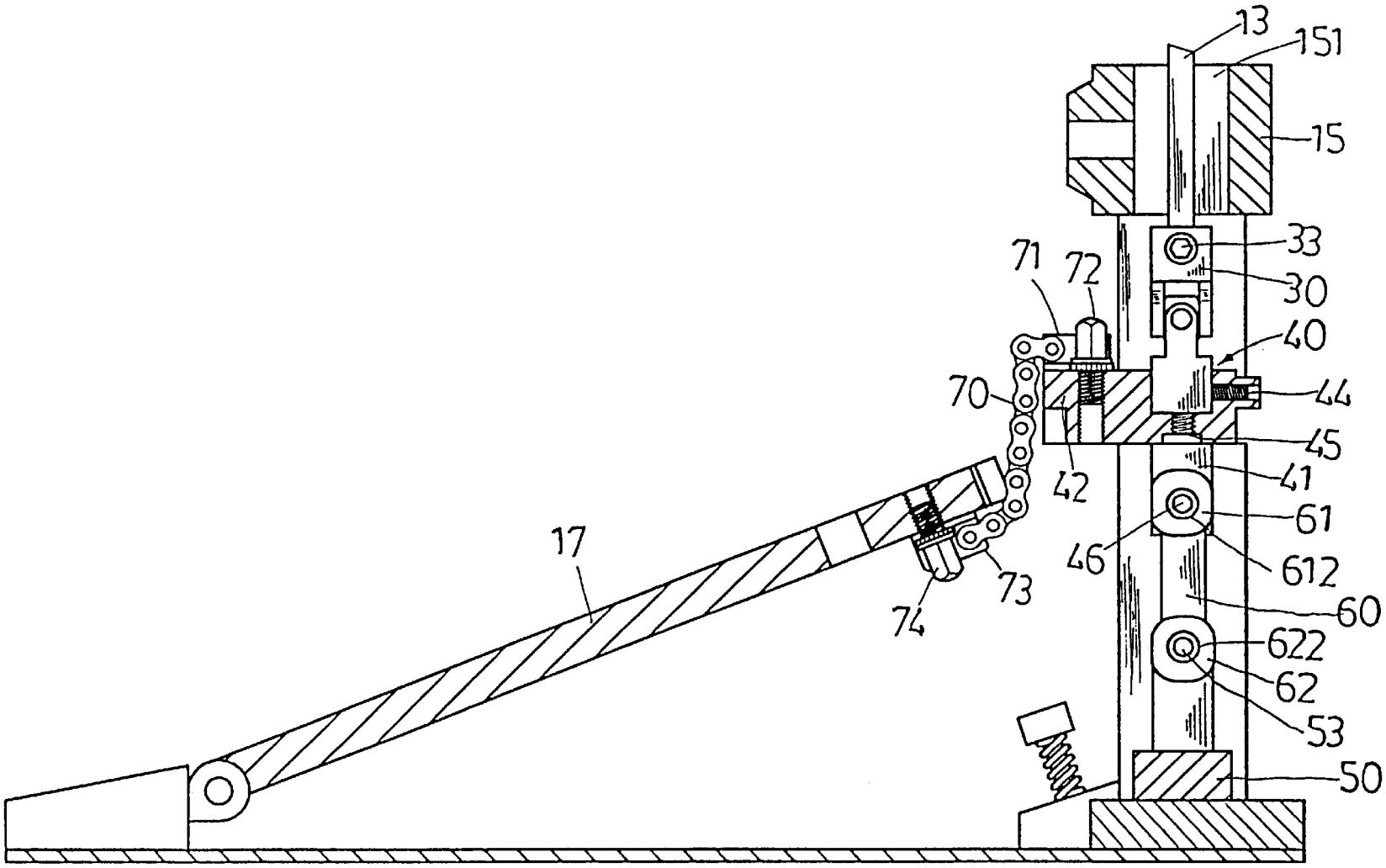
FIG. 5A is the schematic cross-sectional view showing the stationary condition of the mechanism of the present invention.
Figure 5B:
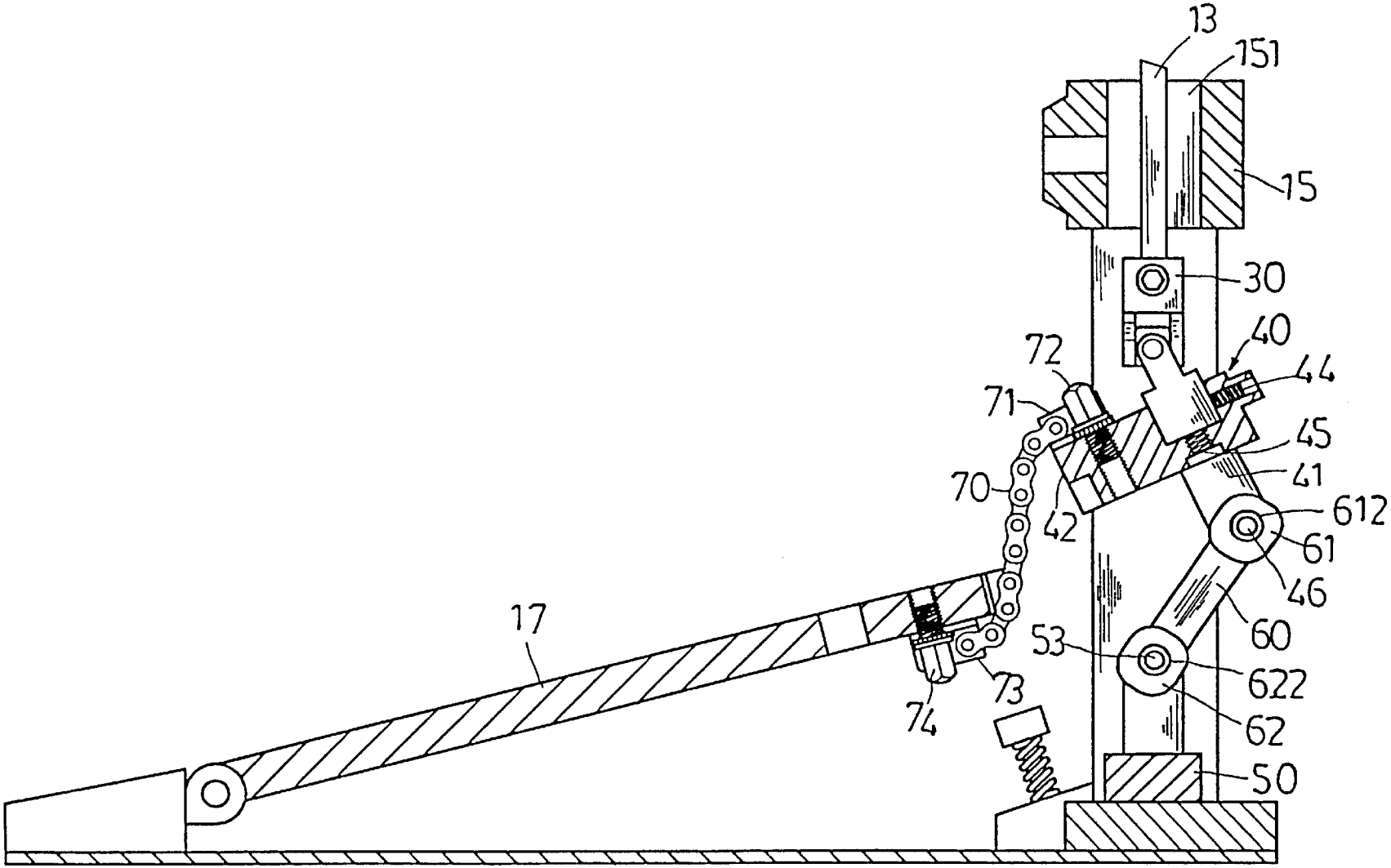
FIG. 5B is another schematic cross-sectional view showing the action of the mechanism of the present invention.

With reference to FIG. 5A, the swinging stand 40 is in balance and the connecting bar 60 is in a vertical position when the mechanism of the pedal operated cymbals of the present invention is stationary. As shown in FIG. 5B, the pedal 17 is pressed down, pulling the chain link 70, and the vertical block 41 of the swinging stand 40 is swung backwards, the connecting bar 60 is pivoted, and at this moment, the swinging stand 40 is also pulled down due to the pressing down of the pedal 17. Consequently, the connecting bar 60 continues to change the angle of inclination that causes the central draw bar 13 to be pulled down smoothly so as to make the movable upper cymbal to hit the stationary lower cymbal and emit a cymbal sound.

When the pedal 17 is released, the universal joint 30 is restored back to the vertical position, the swinging stand 40 returns to a balanced position, and in the mean time, the connecting bar 60 also returns to a vertical position, and consequently, the central draw bar 13 is propped upward to return back to the original position, thereby moving the upper cymbal away from the stationary lower cymbal.

By the foregoing mechanism, the swinging stand unit 20 of the present invention allows the user to push down the pedal 17 with ease and with economy of motion, and each unit can remain at a high level of stability as the pedal and the swinging stand unit 20 perform repeated motions, without rattling and generating excessive noise. Besides being efficient in the pedaling motion, the quick response of the device to return to the original position of the swinging unit 20 improves the quality of the responses of the cymbals.

Although the present invention has been illustrated and described previously with reference to the preferred embodiment thereof, it should be appreciated that it is in no way limited to the details of such embodiment, but is capable of numerous modification within the scope of the appended claims.

What is claimed is:

1. A swinging stand structure for pedal operated cymbals having a pedal, and a central draw bar having a bottom end, wherein the bottom end of said central draw bar is penetrated through a base stand having a bottom and connected to a swinging unit, comprising:

A universal joint having a top end and a bottom end, wherein the top end of said universal joint is connected to the bottom end of said central draw bar;

A swinging stand having reversed L-shape and a top, comprising a vertical block having at least one bottom end and a horizontal block wherein a recess is provided at the top of said swinging stand to contain the bottom end of said universal joint, an opening provided between said horizontal block and said vertical block, a penetrating hole provided near each of the bottom ends of said vertical block;

A U-shaped rod stand, having a central opening, longitudinal sidewalls and a second penetrating hole provided on each of said longitudinal sidewalls;

A connecting bar having an upper end and a lower end wherein an upper connecting block having a block hole is provided at the upper end of said connecting bar that is contained in the opening of said swinging stand, said connecting bar including a lower connecting block having a second block hole, said lower connecting block contained in the central opening of said rod stand, said connecting bar pivotable at both of its ends via pivoting rods that penetrate through said rod holes and said block holes respectively; and A chain link with one end connected to said horizontal block and other end of said chain link connected to said pedal.

2. An improved swinging stand structure of pedal operated cymbals as claimed in claim 1 wherein a lining tube is provided for each of said block holes to receive said pivoting rods.

3. An improved swinging stand structure of pedal operated cymbals as claimed in claim 1 wherein at least one washer is provided at each connecting position between said connecting bar and said swinging stand and said rod stand.

* * * * *